US006384338B2

(12) United States Patent
Abe

(10) Patent No.: US 6,384,338 B2
(45) Date of Patent: May 7, 2002

(54) COMPOSITE ELECTRICAL INSULATOR

(75) Inventor: Tetsuhiko Abe, Virginia Beach, VA (US)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/794,798

(22) Filed: Feb. 27, 2001

Related U.S. Application Data

(62) Division of application No. 09/288,928, filed on Apr. 9, 1999.

(51) Int. Cl.[7] ..... H01B 17/00

(52) U.S. Cl. ..... 174/138 R; 174/178; 174/179; 174/180; 174/169

(58) Field of Search ..... 174/138 R, 169, 174/176, 178, 179, 180, 192, 189, 193

(56) References Cited

U.S. PATENT DOCUMENTS

| | | | | |
|---|---|---|---|---|
| 4,296,276 | A | 10/1981 | Ishihara et al. | 174/179 |
| 5,563,379 | A | 10/1996 | Kunieda et al. | 174/169 |
| 5,633,478 | A | 5/1997 | Ishino | 174/179 |
| 6,010,348 | A | 1/2000 | Alden | 439/274 |
| 6,033,201 | A | 3/2000 | Kashiwagi | 425/116 |

FOREIGN PATENT DOCUMENTS

| | | |
|---|---|---|
| EP | 0 617 433 | 9/1994 |

*Primary Examiner*—Dean A. Reichard
*Assistant Examiner*—W. David Walkenhorst

(74) *Attorney, Agent, or Firm*—Burr & Brown

(57) ABSTRACT

A composite insulator is provided. At least one metal end fitting is provided having a sleeve portion which defines a bore with a first diameter, d1. An insulator subassembly is then formed. The insulator subassembly includes a rod of electrically insulating plastic material and an insulator sheath covering at least a portion of the outer surface of the rod. An end portion of the sheath has a deformable circumferential ridge formed on the outer surface thereof. This circumferential ridge has a second diameter, d2, which is greater than the first diameter, d1. The insulator subassembly is then inserted into the bore of the metal end fitting with a spacer member interposed between the metal end fitting and at least the circumferential ridge. The spacer member serves to deform the ridge to define a temporary vent for allowing air within the bore to escape. The spacer member is then removed thereby allowing the resilient ridge to return to its original size and shape to form a tight seal between the metal end fitting and the insulator subassembly. The resultant composite insulator has a construction which includes an insulator subassembly including a rod and a sheath covering at least a portion of the outer surface of the rod. The sheath has an end portion and at least one deformable circumferential ridge formed on an outer surface thereof. The composite insulator also includes a metal end fitting having a sleeve portion that surrounds the end portion of the sheath. An end region of the metal end fitting that overlaps the ridge is free from deformation. As a result, it is no longer necessary to crimp the metal end fitting to form a good seal, although the crimping step could be performed if additional tigntness is desired.

7 Claims, 3 Drawing Sheets

COMPOSITE ELECTRICAL INSULATOR

CROSS REFERENCE TO RELATED APPLICATION

This is a divisional application of U.S. Ser. No. 09/288,928, filed Apr. 9, 1999, the entirety of which is incorporated herein by reference.

BACKGROUND OF THE INVENTION

1. Field of the Invention

The present invention relates generally to the field of composite electrical insulators, and more particularly to methods of assembling and manufacturing a composite electrical insulator comprising an insulator sub-assembly and a metal end fitting, and the resultant composite electrical insulator.

2. Description of the Related Art

For quite some time composite electrical insulators have been used to insulate high tension wires from the towers to which they are anchored. Over time this field has become fairly complex as engineers have continually improved these insulators. In recent years, it also been a priority to improve the ease with which these insulators are produced. For example, U.S. Pat. No. 5,563,379 to Kunieda et al., incorporated by reference herein, shows, with reference to FIG. 1 herein, a composite electrical insulator 100 capable of maintaining good water-tightness between a metal fitting 102 and a sheath 104 without an increased clamping force. The metal end fitting 102 has a sleeve portion 106 defining a bore 107 in which the end portion of an FRP rod 108 is received. The FRP rod 108 is covered by the sheath 104, which has two circumferential ridges 110 on its outer surface. As shown in FIG. 2A, the circumferential ridges each have an outer diameter ($d_2$). The inner diameter (d1) of the bore 107 defined by the sleeve portion 106 is greater than the outer diameter (d2) of the circumferential ridges 110. In order to prevent water from leaking into the space between the sleeve 106 and the ridge 110, as shown in FIG. 2*b*, Kunieda et al. crimped the sleeve portion 106 onto the circumferential ridges 110 to force intimate contact between the circumferential ridges 110 and the inner surface of the bore 107 of the metal fitting 102. Once assembled, the circumferential ridges 110 served as O-rings which prevented the water from penetrating inside the metal fitting 102. That is, when the sleeve portion 106 of the metal fitting is applied with a moderate crimping force, the circumferential ridges 110 are compressed by the metal fitting 102 into conformity with any unevenness on the inner surface of the metal fitting 102, thereby maintaining the desired water-tightness for a long period.

However, one problem with manufacturing an insulator according to this method is that if there is any variance in the dimensioning of the bore 107 and the circumferential ridges 110, the ridges 110 may not completely contact the inner surface of metal fitting 102. Similarly, any eccentricity between the sleeve portion 106 and the bore 107 may result in a gap between the sleeve 106 and ridges 110. In either case, there is a chance water may leak into the gap between the sleeve 106 and the ridges 110. This is dangerous since water may possibly penetrate the boundary between the FRP rod 108 and the sheath 104, and the electrical insulating performance of the insulator will deteriorate so much that electrical discharge (i.e., flashover) will occur. As a result, the very function these insulators are intended to perform (i.e., insulation) is destroyed. Such water leakage can also cause rusting of the inner surface of metal fitting 102, which in turn relaxes the crimping force between the rod/sheath insulator subassembly and metal fitting 102.

The only way to ensure a good fit between the sheath and the metal fitting and thus guard against such water leakage is to ensure extremely precise dimensional control of the circumferential ridges 110 and the inner surface of the metal fitting 102. The former requires precisely machined molds, and the latter requires precise machining of the metal end fitting. Both complicate the manufacturing process and increase cost.

Additionally, because the outer diameter (d2) of the circumferential ridges 110 is less than the inner diameter of the bore defined by the metal fitting 102, that portion of the metal fitting 102 overlapping the circumferential ridge 110 must be crimped to compress the ridge 110 and form a good seal. This crimping step is in addition to the crimping step used to plastically deform the metal fitting 102 around the FRP rod 108. It would be desirable to eliminate this second crimping step to make the insulator easier and cheaper to assemble.

Thus, there is a clear need in the industry for a composite electrical insulator which is more easily and securely assembled to a metal end fitting member. By eliminating the associated need for high precision dimensional control and two crimping steps, manufacturing time and expense could be significantly reduced.

SUMMARY OF THE INVENTION

It is an object of the present invention to overcome the above-discussed drawbacks associated with prior art assembly methods.

It is a further object of the present invention to eliminate the need for precise dimensional control of components used to assemble an insulator.

It is yet a further object of the present invention is to simplify manufacturing by eliminating the necessity of the second crimping step in assembling a metal end fitting and an insulator sub-assembly.

In order to alleviate the need for precise dimensional control of the components of the insulator and to eliminate the second crimping step, the inventor tried making the diameter (d2) of the circumferential ridge greater than the inner diameter (d1) of the bore in the metal end fitting so that the circumferential ridge would form a seal with the inner surface of the metal end fitting without crimping that portion of the metal end fitting that overlaps the ridge.

However, by solving one problem another was created. When the insulator subassembly was forced into the bore of the metal end fitting, any air present in the cavity became trapped, since the diameter of the ridge (d2) was greater than the inner diameter (d1) of the metal end fitting. The trapped air was compressed by insertion of the insulator subassembly and acted as a counter force to push the subassembly back out of the metal end fitting. That is, once the force being used to insert the insulator subassembly was removed, the air pressure inside the bore forced the insulator subassembly out of the bore.

The inventor considered putting a vent in the bottom of the metal end fitting to allow any trapped air to be forced out of the cavity upon insertion of the subassembly. However, such a vent created additional manufacturing steps , in that it had to be formed in the metal end fitting and then sealed to prevent water leakage. The sealant material would likely break down over time and allow water to enter the interior of the metal end fitting, causing it to rust and destroy the crimping strength of the fitting on the FRP rod, and leading to flashover, as discussed earlier.

To overcome the problem of trapped air, the inventor inserted a spacing member on top of and across the circumferential ridge(s) of the sheath during insertion of the rod/sheath insulator subassembly into the metal end fitting. The spacing member deforms the ridge, which is resilient, and provides a temporary venting passageway to allow the air in the cavity to escape when the insulator subassembly is forced into the cavity of the metal end fitting. Once the air under pressure in the cavity escapes, the spacing member is removed. The resilient ridge then returns to its original size and shape to form a tight seal between the metal end fitting and the insulator subassembly.

The spacing member can be of any shape which will temporarily deform the ridge(s) and allow air to escape from the cavity during the insertion step. For instance, the spacing member could have a hollow tubular construction for allowing the air to vent through the spacing member. Alternatively, the spacing member could simply be a cord or wire of sufficient diameter to allow air to vent around the cord or wire and out of the cavity.

To carry out the objects described above, methods of manufacturing and assembling a composite insulator are provided. According to these methods at least one metal end fitting is provided having a sleeve portion which defines a bore with a first diameter, d1. An insulator subassembly is then formed. The insulator subassembly includes a rod comprising an electrically insulating plastic material, and an insulator sheath covering at least a portion of the outer surface of the rod. An end portion of the sheath has a deformable circumferential ridge formed on the outer surface thereof. This circumferential ridge has a second diameter, d2, which is greater than the first diameter, d1. The insulator subassembly is then inserted into the bore of the metal end fitting with a spacer member interposed between the metal end fitting and at least the circumferential ridge. The spacer member serves to deform the ridge to define a temporary vent for allowing air within the bore to escape. The spacer member is then removed thereby allowing the resilient ridge to return to its original size and shape to form a tight seal between the metal end fitting and the insulator subassembly.

As a result, the resultant composite insulator has a construction which includes an insulator subassembly including a rod comprising an electrically insulating plastic material and a sheath covering at least a portion of the outer surface of the rod. The sheath has an end portion and at least one deformable circumferential ridge formed on an outer surface thereof. The ridge has a second diameter, d2. Preferably, the sheath is made of a resilient and electrically insulating material. The composite insulator also includes a metal end fitting having a sleeve portion defining a bore having a diameter, d1, that is less than the second diameter, d2. The metal end fitting surrounds the end portion of the sheath, and an end region of the metal end fitting that overlaps the ridge is free from deformation. As a result, it is no longer necessary to crimp the metal end fitting to form a good seal, although the crimping step could be performed if additional tigntness is desired.

Additional objects, advantages, and other novel features of the invention will become apparent to those skilled in the art upon examination of the detailed description and drawings that follow.

BRIEF DESCRIPTION OF THE DRAWINGS

The present invention will be further explained in detail hereinafter with reference to the accompanying drawings, in which.

DESCRIPTION OF THE PREFERRED EMBODIMENT

To carry out the objects described above, methods of manufacturing and assembling a composite insulator 1 are provided.

Figure 1:
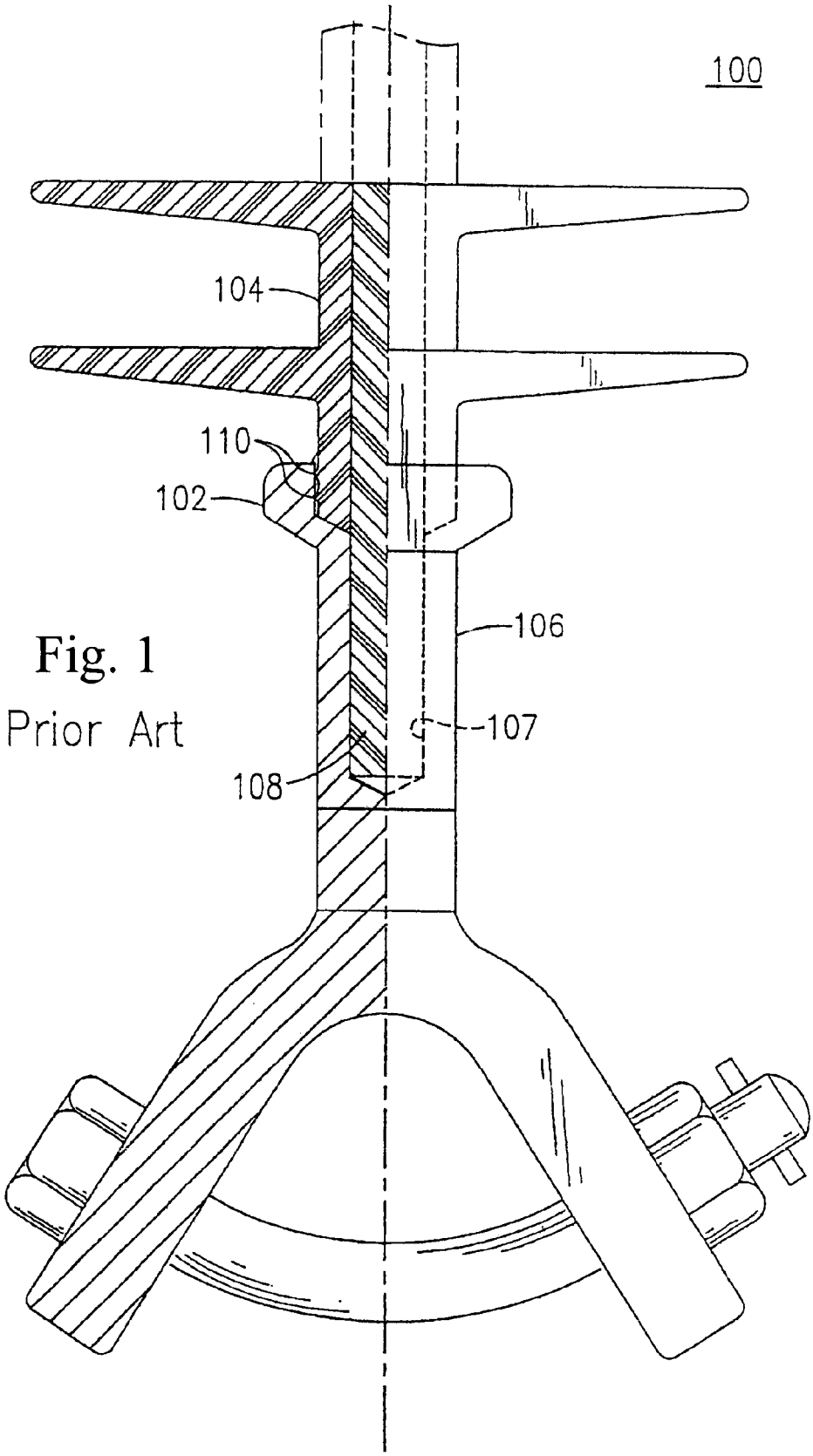
Fig. 1 Prior Art
FIG. 1 is a fragmentary front view, partly in longitudinal section, showing a ground side of a prior art composite insulator.
Figure 2A:
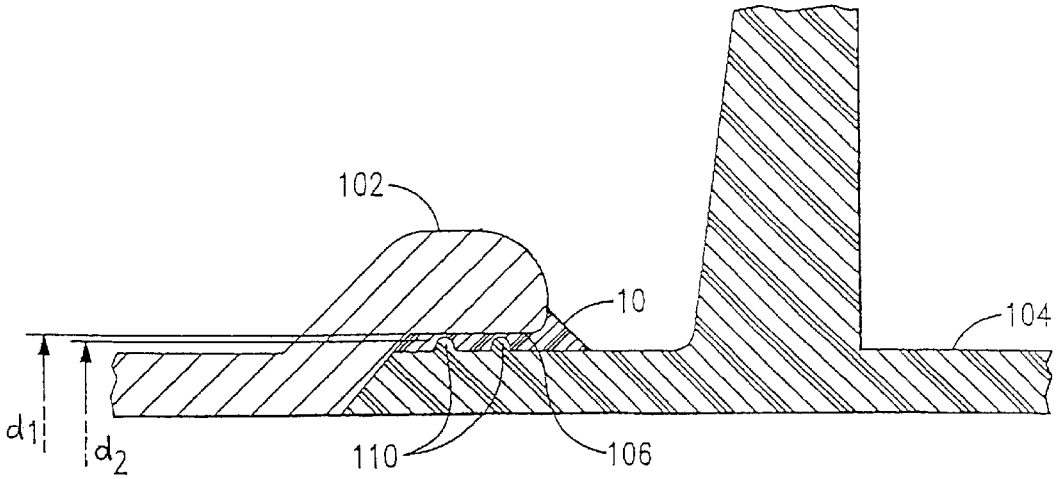
Fig. 2A Prior Art
FIG. 2A is a fragmentary longitudinal-sectional view showing a prior art metal fitting and sheath before fixedly securing the metal fitting to the plastic rod.
Figure 2B:
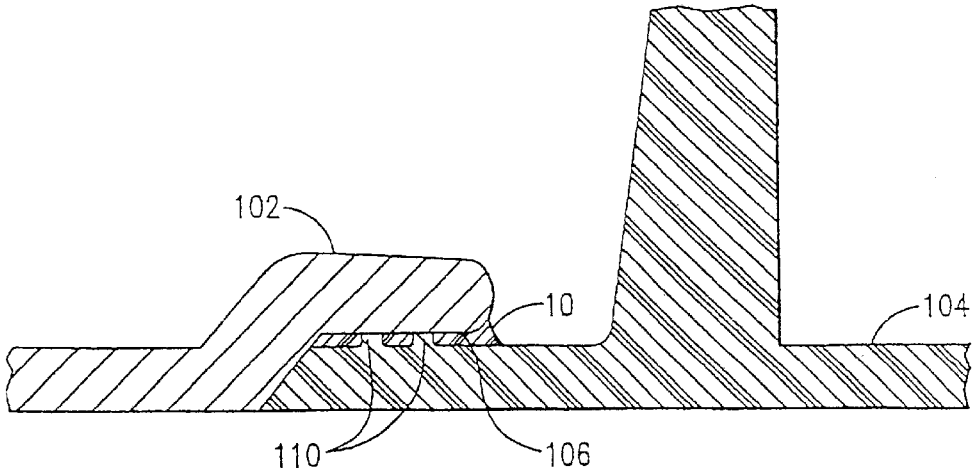
Fig. 2B Prior Art
FIG. 2B is a similar sectional view showing the prior art metal fitting and sheath after the metal fitting has been fixedly secured to the plastic rod;.
Figure 3A:
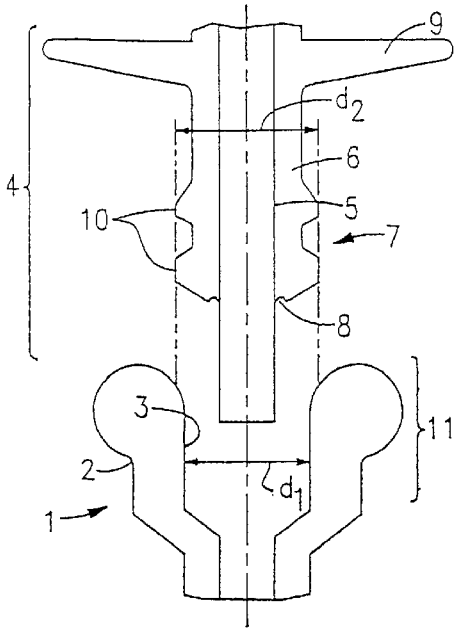
FIG. 3A is a side view of the metal end fitting and insulator subassembly according to the present invention just before the spacer member is placed above the ridges of the insulator subassembly.

As shown in FIG. 3A, at least one metal end fitting 1 is provided having a sleeve portion 2 which defines a bore 3 with a first diameter, d1. The metal end fitting 1 may comprise a high tension steel, aluminum, ductile iron or other appropriate metal, which has been plated by zinc, for example.

The insulator subassembly 4 is then formed. The insulator subassembly 4 includes a rod 5 comprising an electrically insulating plastic material, and an insulator sheath 6, covering at least a portion of the outer surface of rod 5.

Preferably, rod 5 is made of a fiber reinforced plastic material. This fiber-reinforced plastic material may comprise knitted or woven fibers or bundles of longitudinally oriented fibers, such as glass fibers or other appropriate fibers having a high moduluses of elasticity, and a thermosetting type synthetic resin, such as epoxy resin, polyester resin or the like, impregnated in the fibers as a matrix resin. Such fiber reinforced plastic material offers superior mechanical strength and improved resistance to tensile, bending, torsional, and compressive forces. This fiber reinforced plastic material also exhibits an excellent weight to strength ratio.

According to one embodiment, when forming the insulator subassembly 4, rod 5 is placed in a mold and sheath 6 is molded around rod 5. Preferably, the end portion 7 of sheath 6 terminates in a generally frustoconical free end having a radially innermost surface region 8 which is axially depressed. This axially depressed surface region at the free end of sheath 6 serves to positively prevent separation of sheath 6 from rod 5 upon thermal expansion or cooling shrinkage of sheath 6. Preferably, sheath 6 is made of a resilient and electrically insulating material, such as silicone rubber (preferably) and ethylenepropylene rubber since these materials offer superior weatherability and anti-tracking characteristics. The insulating sheath 6 should also include a series of shed portions 9 which are axially spaced from one another to preserve a desired surface leakage distance.

The end portion 7 of sheath 6 should also include at least one deformable circumferential ridge 10 formed on the outer surface thereof to provide a tight seal with the inner surface of metal fitting 2 defining bore 3. The outer surface of sheath 6 may include a plurality of circumferential ridges 10 axially spaced from one another by a predetermined distance. Preferably, all circumferential ridge(s) 10 have a semi-circular cross-section, although any suitable cross-section could be used.

Each circumferential ridge 10 has a second diameter, d2, which is greater than first diameter, d1. By making the diameter (d2) of the circumferential ridge 10 greater than the inner diameter (d1) of the bore 3 in metal end fitting 1, the circumferential ridge 10 forms a seal with the inner surface of the metal end fitting 1 without crimping that portion of metal end fitting 1 that overlaps the ridge 10. Additionally, providing this positive seal between the ridge 10 and the metal end fitting 1 eliminates the need for precise dimensional control of the components of the insulator. Accordingly, a good tight water seal can be formed without the need for precise dimensional control over the components of the insulator and without the need for a second crimping step to compress the circumferential ridges.

Figure 3B:
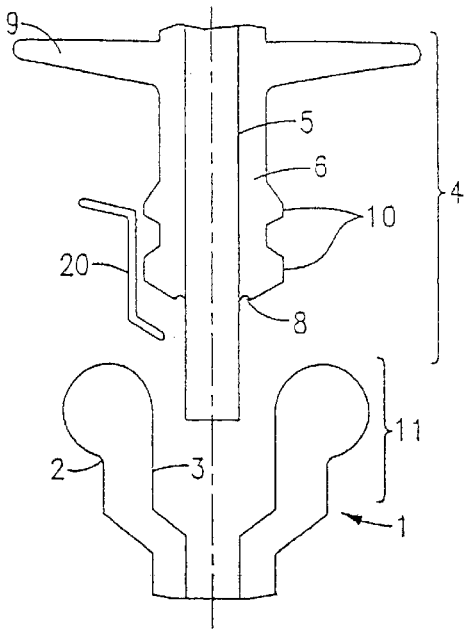
FIG. 3B is a side view of the metal end fitting and insulator subassembly according to the present invention with the spacer member in place just before the insulator subassembly is inserted according to the present invention.
Figure 4:
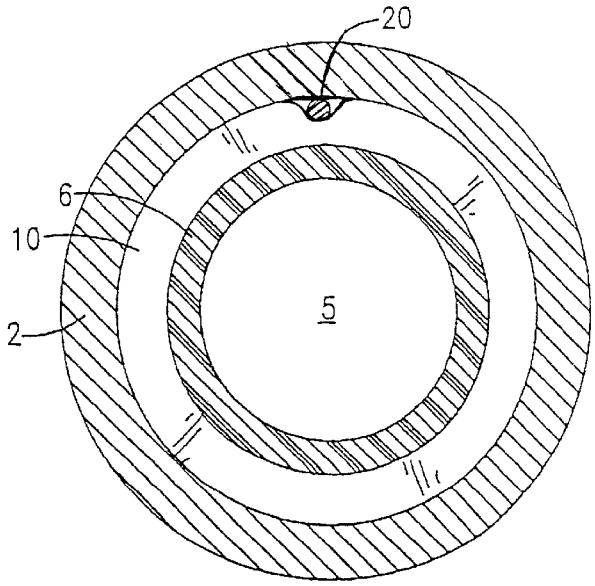
FIG. 4 is a cross-sectional view of the composite electrical insulator according to the present invention showing the spacer member (before removal) acting as a longitudinal venting passageway between the ridge and the metal end fitting of the present invention.

The insulator subassembly 4 is then inserted into the bore 3 of metal end fitting 1. As shown in FIGS. 3B and 4, in order to prevent any air present in bore 3 from becoming trapped when the insulator subassembly 4 is forced into the bore 3 of metal end fitting 1, a spacer member 20 is interposed between the metal end fitting 2 and the circumferential ridges 10. Since end portion 7 of sheath 6 can have one or more ridges 10, it should be recognized that spacer member 20 must rest on top of and across each circumferential ridge 10 in order to provide a venting passageway during insertion of the subassembly 4 into the metal end fitting 1. It is the spacer member 20 which serves to deform the resilient ridge(s) 10, to allow air in bore 3 to escape when the insulator subassembly 4 is forced into bore 3.

The spacer member 20 should be made of a material that will not deform when interposed between metal end fitting 1 and circumferential ridge 10. Preferably, spacer member 20 should be made of nylon to prevent damage to ridge 10 when spacer member 20 is removed. Moreover, spacer member 20 can be of any shape which will temporarily deform ridge(s) 10 and allow air to escape from bore 3 during the insertion step. The spacer member 20 may have either a hollowed or solid cross-section. For instance, the spacer member 20 could have a hollow tubular construction for allowing the air to vent through the spacer member. Alternatively, the spacer member could simply be a cord or wire of sufficient diameter to allow air to vent around the cord or wire and out of the cavity. In preferred the embodiments, the cross-sectional shape of the spacer member is round to prevent ridge 10 from tearing. However, any shape could be used so long as it has an adequate radius of curvature to allow air present within bore 3 to escape, and does not damage ridge 10.

Once the air under pressure in the cavity escapes, spacer member 20 is removed. The resilient ridge 10 then returns to its original size and shape to form a tight seal between metal end fitting 1 and the insulator subassembly 4.

As should be clear from the above description, the resultant composite insulator has a construction which includes an insulator subassembly 4 including a rod 5 comprising an electrically insulating plastic material and a sheath 6 covering at least a portion of the outer surface of rod 5. The sheath 6 has an end portion 7 and at least one deformable circumferential ridge 10 formed on an outer surface thereof. The ridge 10 has a second diameter, d2. The composite insulator also includes a metal end fitting 1 having a sleeve 2 portion defining a bore 3 having a diameter, d1, that is less than the second diameter, d2. The metal end fitting 1 surrounds the end portion 7 of sheath 6, and an end region 11 of the metal end fitting 1 that overlaps ridge 10 is free from deformation (i.e., the second crimping step is unnecessary). However, it should be recognized that end region 11 could be crimped to improve water tightness.

While the present invention has been described with reference to certain preferred embodiments, they were given by way of examples only. Various changes and modifications may be made without departing from the scope of the present invention as defined by the appended claims.

For instance, the tightness between sheath 6 and metal fitting 1 may be improved by filling the gap therebetween with a sealant resin, such as silicone rubber.

I claim:

1. A composite electrical insulator, comprising:

a metal end fitting having a sleeve portion defining a bore having a first diameter, d1; and an insulator subassembly including a rod comprising an electrically insulating plastic material, and a sheath covering at least a portion of the outer surface of said rod, said sheath having an end portion and at least one deformable circumferential ridge formed on an outer surface thereof, said ridge having a second diameter, d2, that is greater than d1;

wherein said metal end fitting surrounds the end portion of said sheath and an end region of said metal end fitting that overlaps said ridge is free from deformation.

2. The composite electrical insulator of claim 1, wherein said sheath comprises a resilient and electrically insulating material.

3. The composite electrical insulator of claim 1, wherein said outer surface of said sheath comprises a plurality of circumferential ridges axially spaced from one another by a predetermined distance.

4. The composite electrical insulator of claim 1, wherein said at least one circumferential ridge has a semi-circular cross-section.

5. The composite electrical insulator of claim 1, wherein said end portion of said sheath terminates in a generally frustoconical free end having a radially innermost surface region which is axially depressed.

6. The composite electrical insulator of claim 1, wherein said metal end fitting further comprises an end region adjacent said end portion of said sheath, and said insulator further comprises a sealant resin interposed between an inner surface of said end region and said outer surface of said sheath.

7. The insulator of claim 1, wherein said rod comprises a fiber reinforced plastic material.

* * * * *